US008220648B2

(12) United States Patent
Barkdoll et al.

(10) Patent No.: US 8,220,648 B2
(45) Date of Patent: Jul. 17, 2012

(54) FOLDED SLATWALL INSERTS

(75) Inventors: Patrick J. Barkdoll, Pecatonica, IL (US); Thomas E. Valiulis, Rockford, IL (US)

(73) Assignee: Southern Imperial, Inc., Rockford, IL (US)

( * ) Notice: Subject to any disclaimer, the term of this patent is extended or adjusted under 35 U.S.C. 154(b) by 243 days.

(21) Appl. No.: 12/184,350

(22) Filed: Aug. 1, 2008

(65) Prior Publication Data

US 2010/0028592 A1 Feb. 4, 2010

(51) Int. Cl.
*A47F 5/08* (2006.01)

(52) U.S. Cl. ..... 211/94.01; 52/506.01

(58) Field of Classification Search ..... 211/94.01; 428/99; 52/506.01, 36.5, 36.4, 511
See application file for complete search history.

(56) References Cited

U.S. PATENT DOCUMENTS

| | | | | |
|---|---|---|---|---|
| 5,121,578 | A * | 6/1992 | Holz | 52/506.01 |
| 5,390,462 | A * | 2/1995 | Kreiter | 52/506.05 |
| 5,857,578 | A | 1/1999 | Fishman | |
| 6,134,846 | A | 10/2000 | Lamb | |
| 6,363,645 | B1 * | 4/2002 | Hunter | 40/618 |
| 6,385,939 | B1 * | 5/2002 | Stout | 52/718.01 |
| 7,108,141 | B2 * | 9/2006 | Gonzalez-Rivera | 211/94.01 |
| D563,567 | S | 3/2008 | Fischer | |
| 2005/0206278 | A1 * | 9/2005 | Gusdorf | 312/6 |

* cited by examiner

*Primary Examiner* — Korie Chan
(74) *Attorney, Agent, or Firm* — Reinhart Boerner Van Deuren P.C.

(57) ABSTRACT

A folded slatwall insert is provided. A slatwall cover is illustrated anchored to a typical slatwall and covering at least one slat of the slatwall. A folded slatwall insert as disclosed prevents surface damage to a typical slatwall, allows for rapid and cost effective customization of the aesthetics of the slatwall, and can be used to mount custom graphics to the slatwall.

22 Claims, 8 Drawing Sheets

FOLDED SLATWALL INSERTS

FIELD OF THE INVENTION

This invention generally relates to retail merchandise display assemblies and more particularly to covering for retail merchandise assemblies.

BACKGROUND OF THE INVENTION

Slatwall displays are often used in the retail merchandise industry to display retail merchandise. A typical slatwall has an array of slats or flat surfaces separated by adjacent channels. A wide variety of retail merchandise support structures may be affixed to a slatwall display via these channels. Typically, a given retail merchandise support structure will be adapted to lock into the slatwall by having mounting features that correspond to the channels, and a backing feature that rests against the horizontal slat between adjacent channels. Prior to installation of the retail merchandise support structures, the slatwall may be painted or fabricated from a colored material to assist in the aesthetic display of retail merchandise contained in the later installed retail merchandise support structures. Several embodiments of slatwalls are illustrated in U.S. Pat. No. 5,857,578 to Fishman, and U.S. Pat. No. 6,134,846 to Lamb.

Over time, as the retail merchandise support structures are installed and uninstalled from the slatwalls, the slats and the channels of the slatwall tend to become damaged or marred from repeated engagement by the mounting features of the retail merchandise support structures. Fortunately, the damage caused does not inhibit the functionality of the slatwalls, yet it is still not desirable to use the slatwalls once damaged for aesthetic reasons. The cost to replace an otherwise functional slatwall can be very high given that the construction of the slatwall is robust and incorporates a substantial amount of material and manufacturing time.

Moreover, once a particular slatwall has been painted or manufactured to be a certain color, it must be repainted or discarded when a new color is desired, such as during the holiday season. In order to repaint or change out the slatwall, one must remove all the retail merchandise support structures thereon. The time required for removal coupled with the time required for repainting can also become very costly.

There exists, therefore, a need in the art for a way to cover and protect the slatwall, as well as way to quickly change the appearance of the slatwall without the high cost of repainting or discarding it for a new color. The invention disclosed herein provides such a solution. These and other advantages of the invention, as well as additional inventive features, will be apparent from the description of the invention provided herein.

BRIEF SUMMARY OF THE INVENTION

The present invention has several aspects that may be claimed and stand as patentable independently and individually or in combination with other aspects, including but not limited to the following.

In one aspect, an embodiment of the invention provides a conformable slatwall cover. A folded slatwall insert according to this aspect comprises a slatwall cover having a center portion that has a width substantially corresponding to the width of a horizontal slat of the slatwall. The center portion serves as a cover for the horizontal slat. The folded slatwall insert also has first and second anchor portions on opposed sides of the center portion. The anchor portions are adapted for anchoring the slatwall cover to the slatwall.

In other aspects, an embodiment of the invention provides a retail display system that may be quickly configured to have different appearances. A slatwall display system according to this aspect comprises a slatwall having a plurality of channels and a plurality of slats defined between adjacent channels. The slats have a front face defined between adjacent channels. The slatwall display system also has at least one slatwall cover that has a center portion and first and second anchor portions. The anchor portions project into and anchor the center portion over the front face of a given slat.

Once installed, the slatwall cover serves to protect the front face and the adjacent channels from being marred or damaged during the installation of retail merchandise support structures. Also, the slatwall display system may be quickly modified to display a different color by removing the slatwall cover and replacing it with another slatwall cover having a different appearance. Changing the slatwall cover itself is a more cost effective solution than repainting or discarding the slatwall. Additionally, the slatwall cover may be manufactured from a transparent material and printed graphics may be placed against a front face of a slat of the slatwall and underneath the slatwall cover, thus allowing for easy viewing while maintaining the condition of the graphics.

In other aspects the invention provides a method for installing a slatwall cover onto a slatwall. A method according to this aspect comprises the steps of anchoring at least one slatwall cover into the channels of the slatwall and covering at least one slat of the slatwall with the slatwall cover. The method may also include unrolling the slatwall cover from a roll and cutting the slatwall cover to a predetermined length. The method may also further include inserting a printed graphic between the slatwall and the slatwall cover or printing a decoration directly on the slatwall cover prior to installation.

Other embodiments of the invention will become more apparent from the following detailed description when taken in conjunction with the accompanying drawings.

BRIEF DESCRIPTION OF THE DRAWINGS

The accompanying drawings incorporated in and forming a part of the specification illustrate several aspects of the present invention and, together with the description, serve to explain the principles of the invention. In the drawings.

While the invention will be described in connection with certain preferred embodiments, there is no intent to limit it to those embodiments. On the contrary, the intent is to cover all alternatives, modifications and equivalents as included within the spirit and scope of the invention as defined by the appended claims.

DETAILED DESCRIPTION OF THE INVENTION

Figure 1:
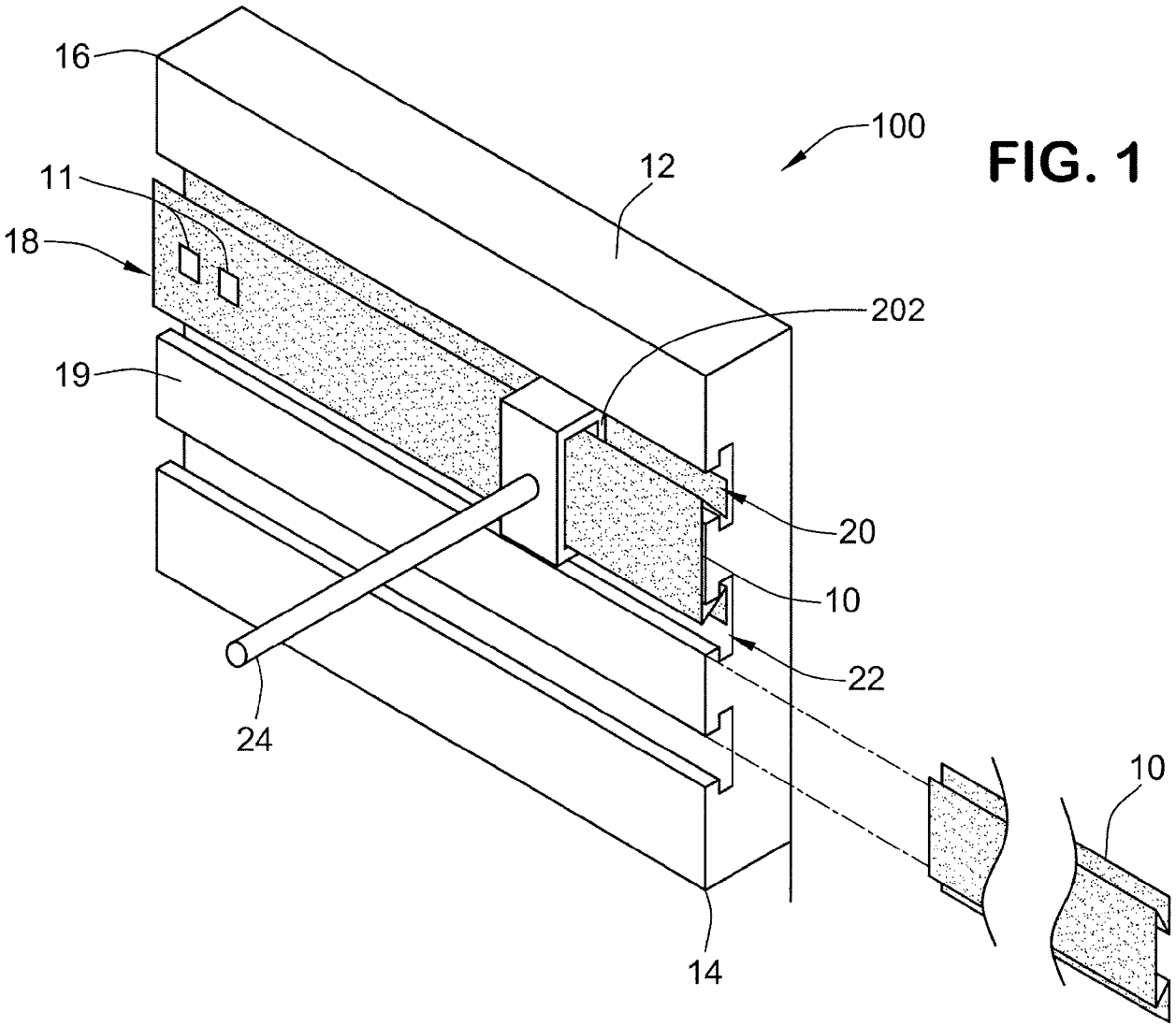
FIG. 1 is an exemplary embodiment of a slatwall display system in accordance with the teachings of the present invention.

Referring to FIG. 1, a slatwall display system 100 is illustrated, which may include a slatwall 12 with a plurality of folded slatwall covers 10 installed thereon. As illustrated, the slatwall cover 10 may function to protect and/or alter the appearance of the slatwall 12. In general, the folded slatwall cover 10 may extend the entirety of the distance defined between slatwall side faces 14, 16 or a portion thereof, and the slatwall cover may be interposed between a retail merchandise support structure 24 and the slatwall 12. As illustrated, the slatwall cover 10 covers one slat 18 of the slatwall 12. However, in other embodiments, the slatwall cover 10 may be manufactured to cover more than one slat 18 as will be discussed in more detail below.

Figure 2:
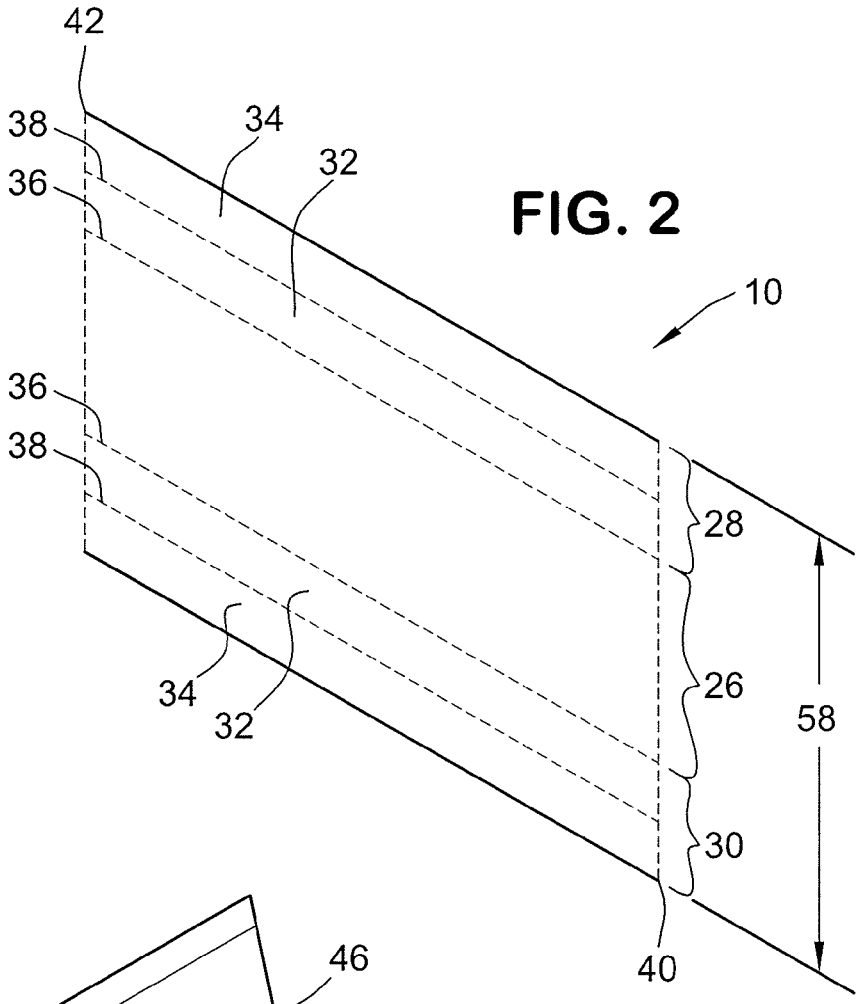
FIG. 2 is a perspective view of a slatwall cover of the slatwall display system of FIG. 1 in an unfolded configuration.

Referring now to FIG. 2, a slatwall cover 10 is illustrated defining a center portion 26, and first and second anchor portions 28, 30 in opposed space relation to one another and sandwiching the center portion 26 therebetween. Each anchor portion may include a connecting section 32 and a wing section 34. The connecting section 32 is connected to the center portion 26 by a first fold line 36. The wing section 34 is connected to the connecting section 32 by a second fold line 38. However, as will be discussed in more detail below, each anchor portion may include a plurality of fold lines and connecting and wing sections to facilitate covering two or more slats 18 while simultaneously conforming to a channel disposed between two adjacent slats. The length of the slatwall cover may extend between transverse cut lines 40, 42 that are generally transverse to the first and second fold lines 36, 38. However, in other embodiments, the length of the slatwall cover 10 may also be defined by the user, by cutting the slatwall cover 10 to a custom length. Although the slatwall cover 10 is illustrated as having a generally uniform and uninterrupted surface, it may also contain a plurality of cut out portions 11, allowing for a partial view of the slatwall front face 19 (See FIG. 1) disposed of behind the slatwall cover 10. A typical slatwall cover 10 may have a length of about six inches to about twenty four feet, and a width of about one half inch to about seventy two inches.

As further illustrated in FIG. 2, the slatwall cover 10 typically has a pair of first and second fold lines 36, 38. The pair of fold lines 36, 38 are in opposed space relation to one another and situated on either side of the center portion 26. In the illustrated embodiment each pair of fold lines 36, 38 extends between the first and second transverse cut lines 40, 42 but may also extend a length along the slatwall cover 10 that is defined by the user, by cutting the slatwall cover 10 at a custom length. The fold lines 36, 38 may be defined by perforations on the slatwall cover 10, or other similar features such as scores, slits, folds, or creases. The aforementioned fold lines 36, 38 allow for the slatwall cover 10 to be folded from an unfolded state to a folded state.

Figure 3:
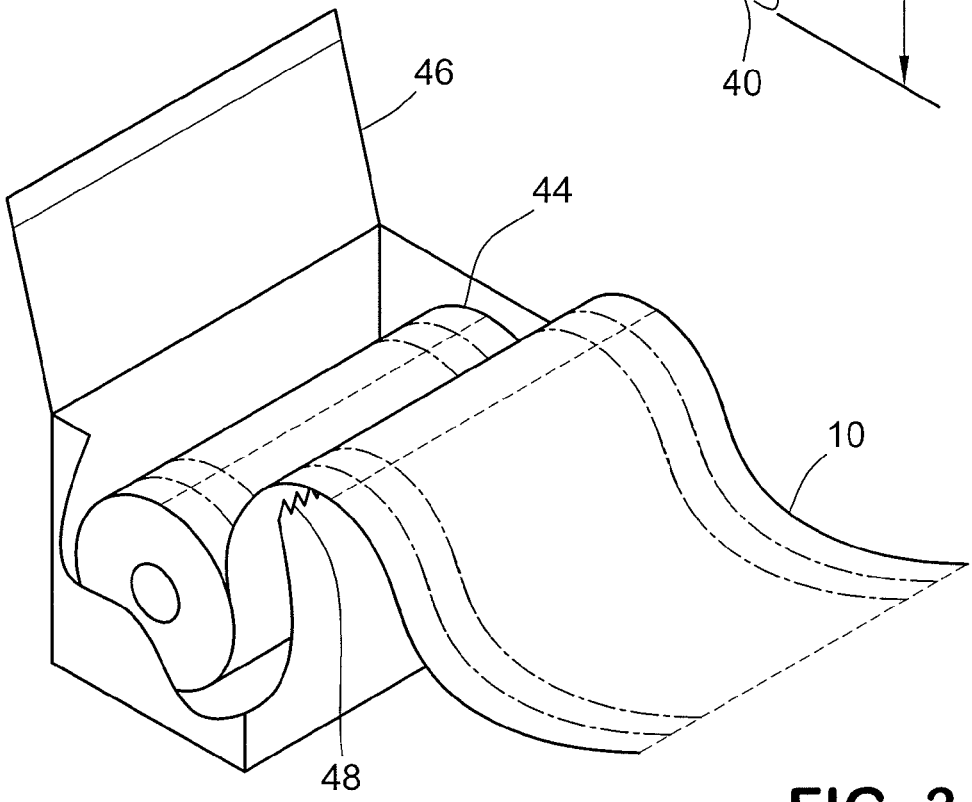
FIG. 3 is a perspective view of the slatwall cover of FIG. 2 in a unfolded and rolled configuration.

Referring now to FIG. 3, a slatwall cover 10 is illustrated in a coiled and unfolded state. As such, when constructed of a generally flexible material, the slatwall cover 10 may be supplied as a roll 44. The slatwall cover may also be supplied as a roll 44 within a container 46. Furthermore, the container 46 may include a cutting edge 48, thus removing the necessity for the transverse cut lines 40, 42. The cutting edge may be formed from metal or plastic, and may be serrated or sharpened to assist cutting. When supplied with the cutting edge 48, the slatwall cover 10 may have a length determined by the user, and not predefined by the transverse cut lines 40, 42.

Figure 4:
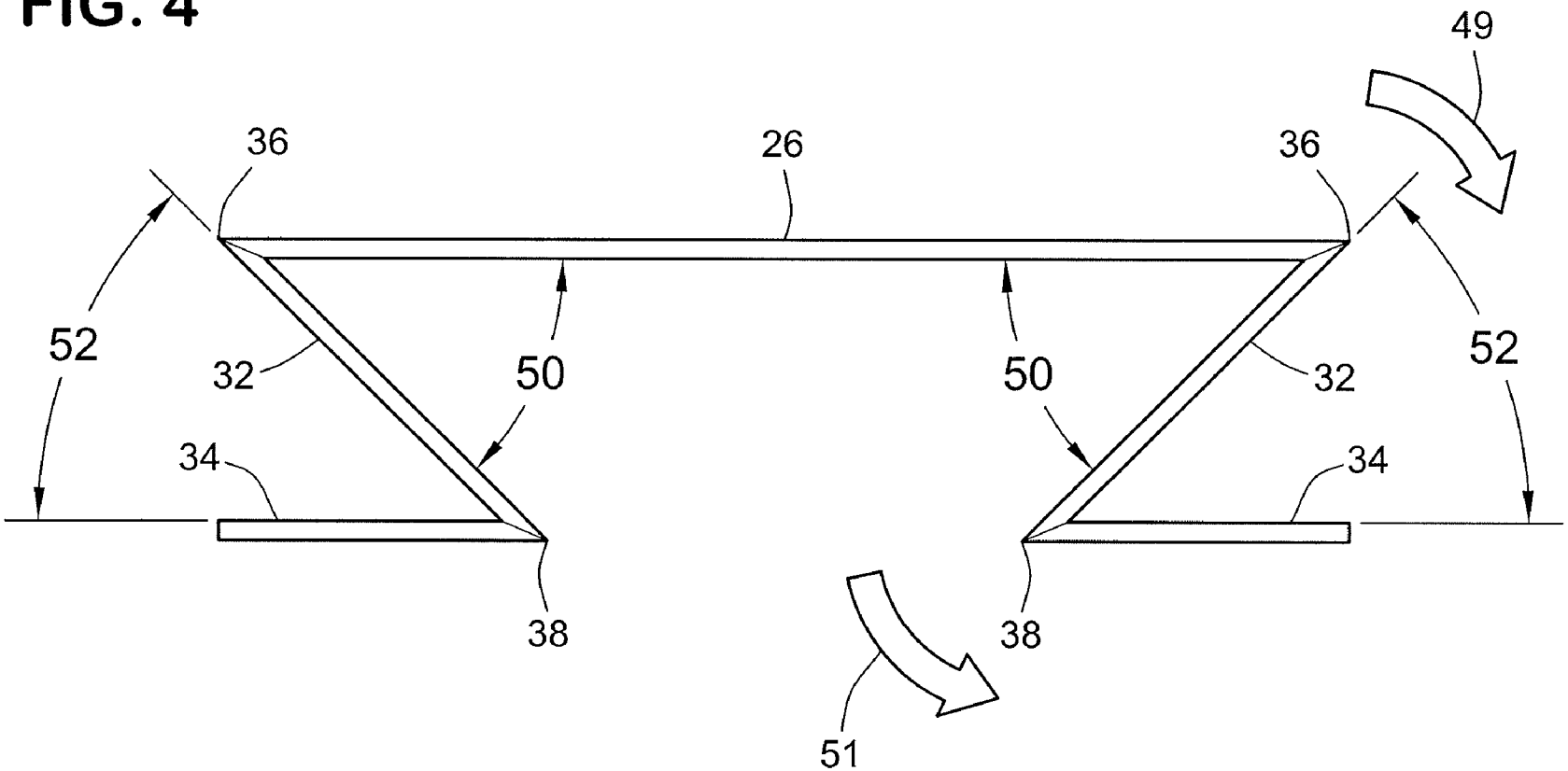
FIG. 4 is an end view of the slatwall cover of FIG. 2 in a folded configuration.

Referring now to FIG. 4, a slatwall cover is illustrated in a folded state. When folded, the slatwall cover 10 has a non planar profile, and generally takes a shape that conforms to a typical slat 18 of a slatwall 12. The slatwall cover 10 may be configured into a folded state from an unfolded state by first rotating the connecting section 32 in a first direction 49 about the first fold line 36. This rotation results in a first angle 50 between the connecting section 32 and the center portion 26. The wing section 34 is then rotated in a second direction 51 about the second fold line 38 resulting in a second angle 52 between connecting and wing sections 32, 34. Typically, angles 50, 52 will be equal such that center portion 26 and wing section 34 are generally parallel. Also, angles 50, 52 will typically be between about one degree and about one hundred eighty degrees. However, the angular measure of angles 50, 52 will be governed by the sizing and shape of the slatwall channel 20, 22.

Figure 5:
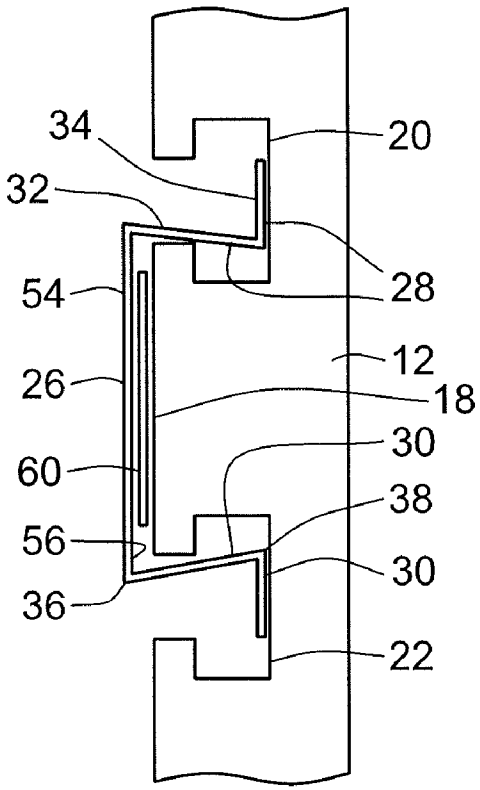
FIG. 5 is a partial side view of the slatwall display system of FIG. 1.

Turning now to FIG. 5, once in a folded state, the slatwall cover 10 generally conforms to at least one slat 18 of the slatwall. The slatwall cover 10 may be installed by first cutting a length of the slatwall cover manually or by using the transverse cut lines 40, 42. The length to be cut may be obtained by first unrolling the slatwall cover 10 from roll 44 (See FIG. 3). The slatwall cover 10 may be removed from the roll by utilizing a transverse cut line 40, 42 or by using the cutting edge 48 on the container 46 that houses the roll 44. The slatwall cover 10 may then be placed into its folded configuration, and then affixed to the slatwall 12 by sliding the anchor portions 28, 30 into channels 20, 22 as illustrated.

As depicted in FIG. 5, the center portion 26 covers at least a portion of slat 18. Alternatively, the slatwall cover 10 may be installed by pressing the center portion 26 against the front face 19 of the slat 18, and then rotating the connecting section 32 about the first fold line 36 inward and into the channel 20. The wing section 34 may then be rotated about the second fold line 38. Folded as illustrated, the connecting and wing sections 32, 34 serve to anchor the slatwall cover 10 in place while orienting the center portion 26 over at least one slat 18.

Additionally, a graphic 60 may be interposed between a rear face 56 of the slatwall cover 10 center portion 26 and the front face 19 of the slat 18. The graphic 60 may be printed and be a mere design, i.e. seasonal symbols, or contain product information thereon. When the slatwall cover 10 is constructed from a transparent material, the graphic may be viewed while simultaneously being protected from damage when placed behind the slatwall cover 10.

Figure 6:
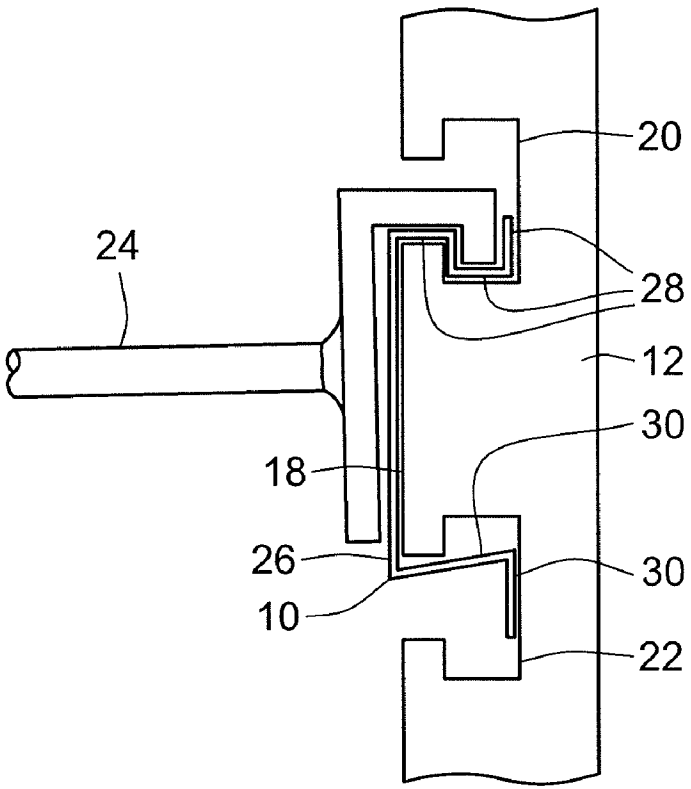
FIG. 6 is a side view of the slatwall cover of FIG. 2, installed on a typical slatwall and incorporating a typical retail merchandise support structure.

Referring now to FIG. 6, once the slatwall cover 10 has been installed as discussed above, a retail merchandise support structure 24 may then be installed onto the slatwall 12. As illustrated, the slatwall cover 10 will be interposed between the slatwall 12 and the retail merchandise support structures 24. The slatwall cover 10 may be constructed of a material that is flexible enough and preferably conformable (e.g. paper material that can crush and readily conform) such that at least one of the anchor portions 28, 30 will conform to any mounting features of the retail merchandise support structure 24.

Figure 7:
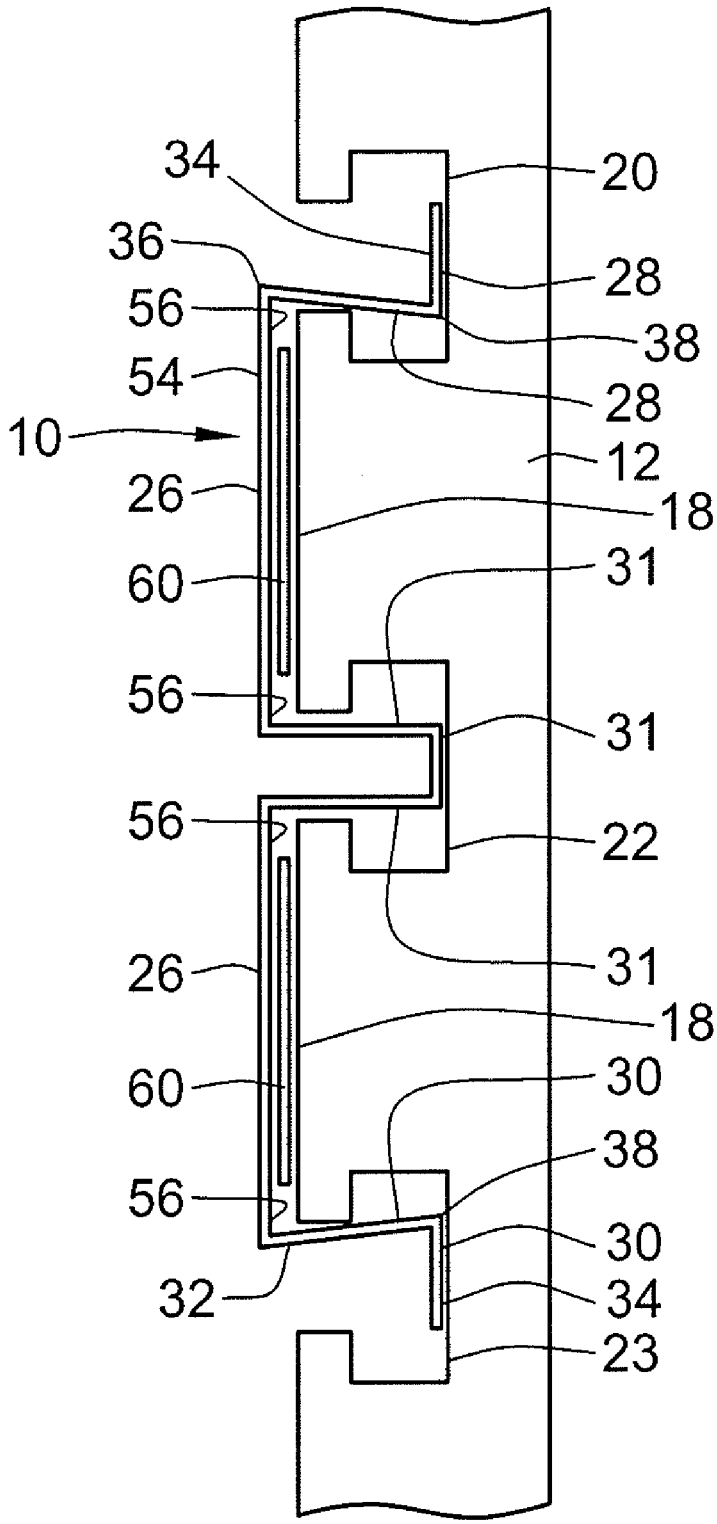
FIG. 7 is a side view of a slatwall cover of the slatwall display system of FIG. 1 covering multiple slats simultaneously.

Referring now to FIG. 7, a slatwall cover 10 is illustrated covering multiple slats 18 at one time. In the illustrated embodiment, the slatwall cover 10 will have a third anchor portion 31 which may have a plurality of fold lines such that the anchor portion 31 may be folded to conform to the channel 22 and an adjacent slat 18 may then be covered as well. As illustrated, a graphic 60 may be interposed between the slatwall cover 10 and the slats 18 of the slatwall 12. Although two adjacent slats 18 have been covered in the illustrated embodiment, the slatwall cover 10 may be manufactured to cover more than two adjacent slats 18 simultaneously.

Figure 8:
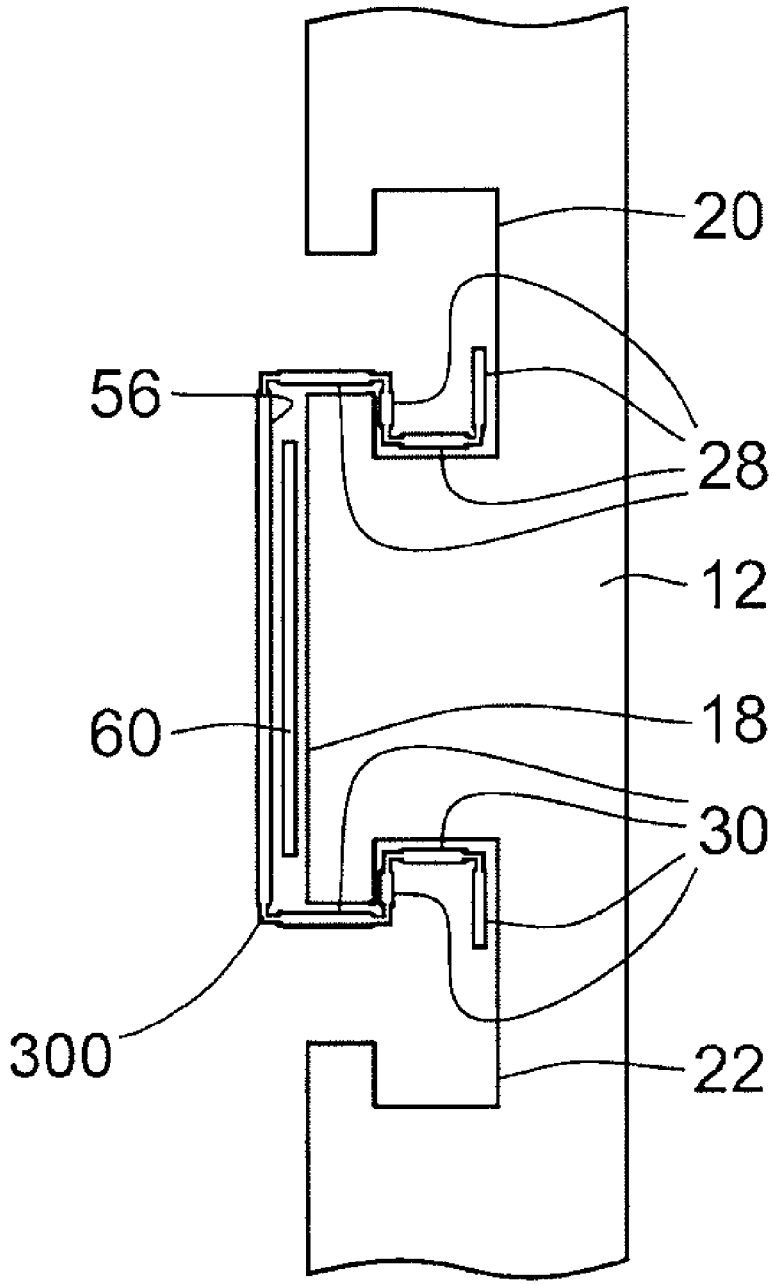
FIG. 8 is a side view of an extruded embodiment of a slatwall cover of the slatwall display system of FIG. 1.

Turning now to FIG. 8, a slatwall cover 10 is illustrated as an extrusion. In this embodiment, the slatwall cover 10 is manufactured in a flat or flattened state with weakened thinner regions of material creating living hinges 300 as fold lines. As such, anchor portions 28, 30 will be formed to generally mirror the interior of channels 20, 22. In this embodiment, the fold lines facilitate subsequent folding of the material after extrusion. Retail merchandise support structure 24 may then be installed on the slatwall 12, wherein the slatwall cover 10 will be interposed between the retail merchandise support structure 24 and the slats 18. A graphic 60 may also be interposed between the slatwall cover 10 and the slat 18 in this embodiment. When the slatwall cover 10 is extruded from a transparent material, the graphic 60 may be viewed by the consumer and protected by the slatwall cover 10.

The slatwall cover 10 may be manufactured by a variety of methods. As an example, the slatwall cover may be manufactured on a flexographic printing press, which can trim the slatwall cover to an appropriate width 58 (See FIG. 2), place the fold and transverse cut lines, 36, 38, 40, 42 and optionally print the slatwall cover 10 with a variety of decorations. The slatwall cover 10 material may be a transparent or opaque flexible plastic, vinyl, paper, or a variety of other materials. All of these materials or covers made can be readily folded, preferably with fold lines formed from thinner regions of material, weakened sections, creases, die impressions, scoring perforations, and/or a combination thereof.

Figure 9:
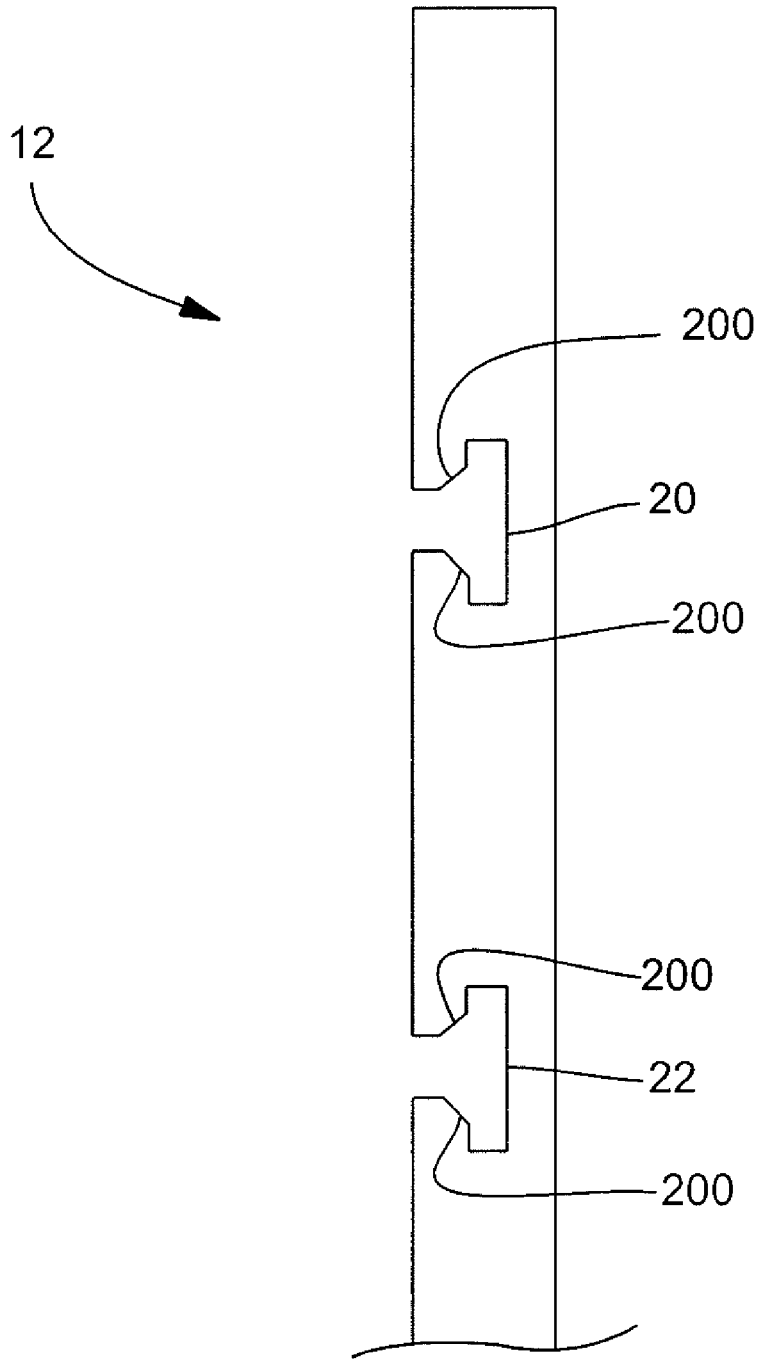
FIG. 9 is a partial side view of an alternative embodiment of a typical slatwall.

Turning now to FIG. 9, an alternative embodiment of a slatwall 12 (See FIG. 1) is illustrated. While illustrated in FIGS. 1, 5, 6, 7, and 8 as having a channels 20, 22 with a generally "T" shaped profile, a slatwall 12 may also have channels having a chamfered interior edge 200. When the slatwall 12 is supplied as such, the slatwall cover 10 will conform to the channels 20, 22 in the same manner as described above.

Figure 10:
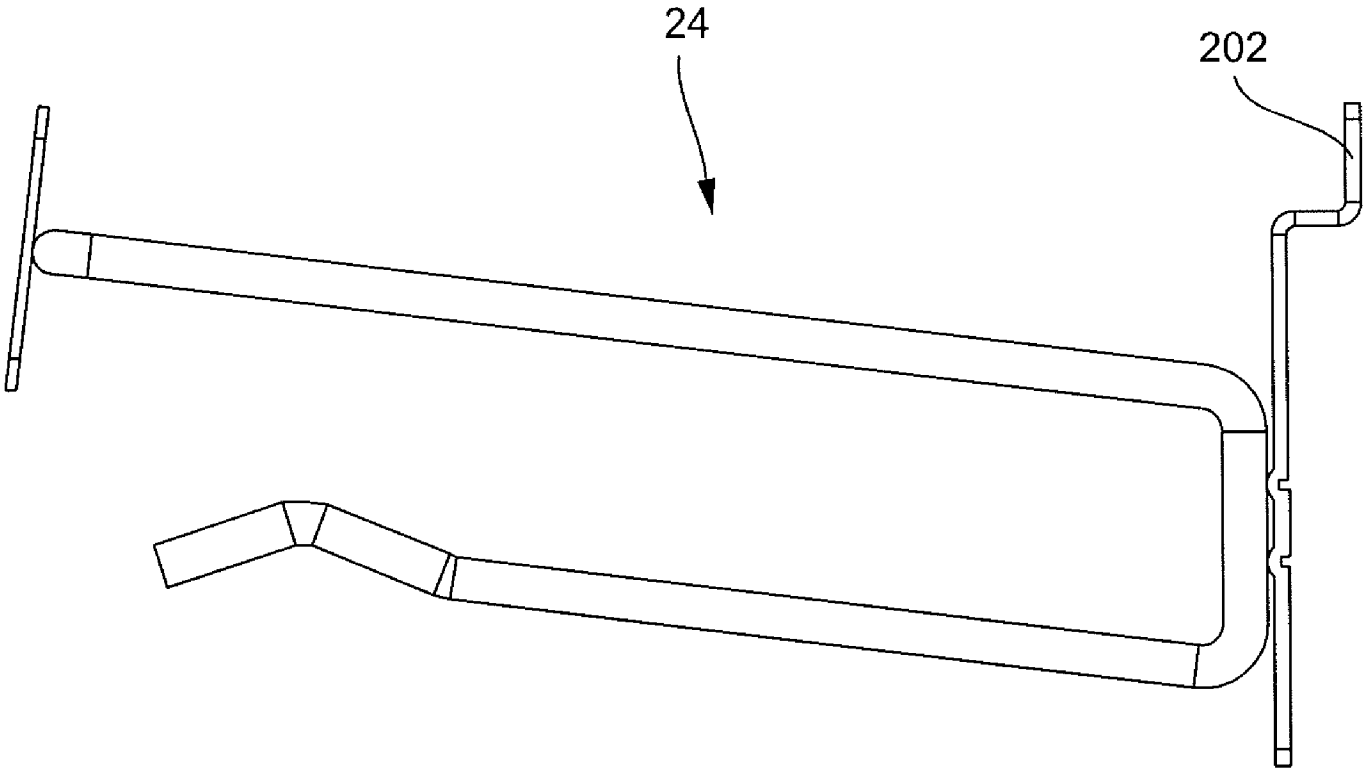
FIG. 10 is a side view of an alternative embodiment of a typical retail merchandise support structure.

Moving now to FIG. 10, an alternative embodiment of a retail merchandise support structure 24 is illustrated. While illustrated in FIG. 1 has having a mounting feature 202 that is adapted to interlock with the slat 18 that the retail merchandise support structure 24 also rests upon, the mounting feature 202 may also be manufactured to interlock with the interior of a vertically adjacent slat 18. This is accomplished where the mounting feature 202 is directed generally upward and away from the retail merchandise support structure 24.

As described herein, the folded slatwall cover 10 prevents surface damage to slatwall 12 slats 18 and channels 20, 22 thus preserving the usage life of a typical slatwall. Moreover, the slatwall cover 10 allows a typical slatwall 12 to take on an infinite number of appearances in a cost efficient manner, by quickly changing out one color/design of slatwall cover for another.

All references, including publications, patent applications, and patents cited herein are hereby incorporated by reference to the same extent as if each reference were individually and specifically indicated to be incorporated by reference and were set forth in its entirety herein.

The use of the terms "a" and "an" and "the" and similar referents in the context of describing the invention (especially in the context of the following claims) is to be construed to cover both the singular and the plural, unless otherwise indicated herein or clearly contradicted by context. The terms "comprising," "having," "including," and "containing" are to be construed as open-ended terms (i.e., meaning "including, but not limited to,") unless otherwise noted. Recitation of ranges of values herein are merely intended to serve as a shorthand method of referring individually to each separate value falling within the range, unless otherwise indicated herein, and each separate value is incorporated into the specification as if it were individually recited herein. All methods described herein can be performed in any suitable order unless otherwise indicated herein or otherwise clearly contradicted by context. The use of any and all examples, or exemplary language (e.g., "such as") provided herein, is intended merely to better illuminate the invention and does not pose a limitation on the scope of the invention unless otherwise claimed. No language in the specification should be construed as indicating any non-claimed element as essential to the practice of the invention.

Preferred embodiments of this invention are described herein, including the best mode known to the inventors for carrying out the invention. Variations of those preferred embodiments may become apparent to those of ordinary skill in the art upon reading the foregoing description. The inventors expect skilled artisans to employ such variations as appropriate, and the inventors intend for the invention to be practiced otherwise than as specifically described herein. Accordingly, this invention includes all modifications and equivalents of the subject matter recited in the claims appended hereto as permitted by applicable law. Moreover, any combination of the above-described elements in all possible variations thereof is encompassed by the invention unless otherwise indicated herein.

What is claimed is:

1. A slatwall cover for a slatwall, the slatwall having a plurality of channels and a plurality of slats defined between adjacent channels, the slats having a slatwall width defined between adjacent channels, the slatwall cover comprising:

a center portion having a width substantially corresponding to the slatwall width for covering a selected one of the plurality of slats;

first and second anchor portions on opposed sides of the center portion, the first and second anchor portions adapted for anchoring the slatwall cover into adjacent channels;

a first fold line connecting the center portion and the first anchor portion;

wherein the first anchor portion includes a first connecting section and a first wing section, the first connecting section is connected to the center portion by the first fold line, and the first wing section is connected to the first connecting section by a second fold line, and wherein the first connecting section is angularly folded about the first fold line in a first angular fold direction and the first wing section is angularly folded about the second fold line in a second angular fold direction opposite the first angular fold direction for anchoring the slatwall cover into one of the adjacent channels; and a third fold line connecting the center portion and the second anchor portion;

wherein the second anchor portion includes a second connecting section and a second wing section, the second connecting section is connected to the center portion by the third fold line, and the second wing section is connected to the second connecting section by a fourth fold line, and wherein the second connecting section is angularly folded about the third fold line in a third angular fold direction and the second wing section is angularly folded about the fourth fold line in a fourth angular fold direction opposite the third angular fold direction for anchoring the slatwall cover into the other one of the adjacent channels;

wherein the center portion has a first width which extends between the first and third fold lines and each of the first and second anchor portions terminates in a distal end, wherein the distal ends of the first and second anchor portions are spaced apart by a second width, the second width greater than the first width; and wherein the connecting sections of the first and second anchor portions are folded inwardly toward one another, and wherein the wing sections of the first and second anchor portions are folded outwardly away from one another.

2. The slatwall cover of claim 1 further comprising first and second transverse cut lines, wherein the transverse cut lines are generally perpendicular to the length of the slatwall cover, being in opposed spaced relation to each other and are selected from the group consisting of perforations, scores, and creases.

3. The slatwall cover of claim 1 wherein the first and second fold lines are selected from the group consisting of perforations, scores, and creases.

4. The slatwall cover of claim 1 wherein the slatwall cover has a flat state and a folded state in which the first and second connecting and first and second wing sections are angularly folded relative to the center portion, each connecting section in the folded state defines a first angle between the center portion and the connecting section of about ten to about one hundred and forty five degrees, and each wing section in the folded state defines a second angle between the wing and the connecting section connected thereto of about ten to about one hundred and forty five degrees.

5. The slatwall cover of claim 1 wherein the slatwall cover is constructed of extruded and generally rigid plastic, and the first, second, third and fourth fold lines are preformed foldable thinner segments of the extrusion forming living hinges.

6. The slatwall cover of claim 1 wherein the slatwall cover is coiled about an axis into a roll.

7. The slatwall cover of claim 1 wherein the slatwall cover is constructed from vinyl.

8. The slatwall cover of claim 1 wherein the slatwall cover is constructed from plastic.

9. The slatwall cover of claim 1 wherein the slatwall cover is constructed from paper.

10. The slatwall cover of claim 1 wherein the slatwall cover material is generally transparent.

11. The slatwall cover of claim 1 wherein the slatwall cover includes decorations printed thereon.

12. The slatwall cover of claim 1 wherein the slatwall cover has a length of about one to about twelve feet, and a width of about 1 to about forty eight inches, the connecting and wing sections each have a width of about one eighth to about one inch, the center portion has a width of about one half to about twenty inches.

13. A slatwall display system, comprising:

a slatwall having a plurality of channels and a plurality of slats defined between adjacent channels, the slats having a front face defined between adjacent channels;

at least one slatwall cover having a center portion and first and second anchor portions, wherein the center portion covers the front face of at least one of the slats;

a first fold line connecting the center portion and the first anchor portion, the first anchor portion being pivotable relative to the center portion about the first fold line;

a third fold line connecting the center portion and the second anchor portion, the second anchor portion being pivotable relative to the center portion about the third fold line;

the first and second anchor portions projecting into and anchoring the center portion over the front face; and wherein the first anchor portion includes a first connecting section and a first wing section, the first connecting section is connected to the center portion by the first fold line, and the first wing section is connected to the first connecting section by a second fold line, and wherein the first connecting section is angularly folded about the first fold line in a first angular fold direction and the first wing section is angularly folded about the second fold line in a second angular fold direction opposite the first fold direction for anchoring the slatwall cover into one of the adjacent channels; and wherein the second anchor portion includes a second connecting section and a second wing section, the second connecting section is connected to the center portion by the third fold line, and the second wing section is connected to the second connecting section by a fourth fold line, and wherein the second connecting section is angularly folded about the third fold line in a third angular fold direction and the second wing section is angularly folded about the fourth fold line in a fourth angular fold direction opposite the third angular fold direction for anchoring the slatwall cover into the other one of the adjacent channels;

wherein the center portion has a first width which extends between the first and third fold lines and each of the first and second anchor portion terminates in a distal end, wherein the distal ends of the first and second anchor portions are spaced apart by a second width, the second width greater than the first width; and wherein the connecting sections of the first and second anchor portions are folded inwardly toward one another, and wherein the wing sections of the first and second anchor portions are folded outwardly away from one another.

14. The slatwall display system of claim 13 wherein a printed graphic is interposed between the slatwall and the slatwall cover.

15. The slatwall display system of claim 13 wherein the first connecting section is angularly folded about the first fold line such that the first connecting portion is disposed rearwardly and transverse to one of the plurality of slats.

16. The slatwall display system of claim 15 wherein the first wing portion is angularly folded about the second fold line such that the first wing portion is disposed rearwardly from and generally parallel to one of the plurality of slats.

17. The slatwall display system of claim 13 wherein the slatwall cover is made from a material selected from the group consisting of vinyl, plastic, paper, metal, and metallic foil.

18. The slatwall cover of claim 13 wherein the slatwall cover has a length of about one to about twelve feet, and a width of about one to about twenty four inches, the connecting and wing sections each have a width of about one eighth to about one inch, the center portion has a width of about one half to about twenty inches.

19. The slatwall cover of claim 1, wherein in a folded state the first and second wing sections are substantially coplanar and extend away from the second and fourth fold lines, respectively, away from one another.

20. The slatwall cover of claim 13, wherein the center portion is substantially parallel with the first and second wing sections in the folded state.

21. The slatwall display system of claim 13 wherein in a folded state the first and second wing sections are substantially coplanar and extend away from the second and fourth fold lines, respectively, away from one another.

22. The slatwall display system of claim 21, wherein the center portion is substantially parallel with the first and second wing sections in the folded state.

* * * * *